United States Patent [19]

Machanian

[11] 4,319,509

[45] Mar. 16, 1982

[54] SEQUENCE GENERATOR FOR AN ELECTRONIC MUSICAL INSTRUMENT

[75] Inventor: William V. Machanian, DeKalb, Ill.

[73] Assignee: The Wurlitzer Company, DeKalb, Ill.

[21] Appl. No.: 155,990

[22] Filed: Jun. 3, 1980

[51] Int. Cl.[3] ..... G10F 1/00

[52] U.S. Cl. ..... 84/1.03; 84/1.24

[58] Field of Search ..... 84/DIG. 12, 1.03, 1.24

[56] References Cited

U.S. PATENT DOCUMENTS

| | | | |
|---|---|---|---|
| 4,158,978 | 6/1979 | Hiyoshi et al. | 84/DIG. 12 |
| 4,179,970 | 12/1979 | Faulkner | 84/1.01 |
| 4,187,756 | 2/1980 | Robinson et al. | 84/1.24 |
| 4,220,068 | 9/1980 | Howell et al. | 84/DIG. 12 |

*Primary Examiner*—J. V. Truhe

*Assistant Examiner*—Forester W. Isen

*Attorney, Agent, or Firm*—Trexler, Bushnell & Wolters, Ltd.

[57] ABSTRACT

A sequence generator system is disclosed for use in an electronic musical instrument wherein scanning circuits scan the instrument and produce a serial data stream corresponding to notes played on the instrument. The sequence generator system comprises sequence generating circuits responsive to the serial data stream for generating a further, predetermined data sequence and data steering circuits for receiving the serial data stream and for normally steering said serial data stream to a data output. Actuation of the system causes the data steering circuits to substitute the predetermined data sequence produced by the sequence generating circuits for the serial data stream at the data output.

14 Claims, 6 Drawing Figures

34
CLOCK 1 (SECOND QUARTER)
CLOCK 2 4TH QUARTER
TIME
SLOT62 SWITCH
NOTE FULL
COUNTER SWITCH
TEMPO CLOCK
DIVIDER
IC6
VCC
SET
CLK
DCLK
STRB
TCLK
38
118
126
128
130
132
134
138
140
142
144
146
148
150
152
154
156
158
160
162
164
166
168
170
174
176
178
180
182
186

12 BIT SHIFT REG
D3
D2+4
D2
D1+4
CLK
D3+4
+V
-V
UM
LM
SERIAL DATA OUT
UM DATA
LM DATA IN

CARRY OUT
CLK
RS
NOTE COUNTER
J1 J2 J3 J4
Q1 Q2 Q3 Q4
184
+V
COUNT UP-DOWN CONTROL F/F
206
208
210
212
240
242
244
254
250
50
48
D1 D2 D3 D4
LATCH
CLK
118
188
A0 A1 A2 A3
A=B
204 COMPARE
A<B
B0 B1 B2 B3
214
256
Q1 Q2 Q3 Q4
UP DN
TEMPO
CLK 190 COUNTER
RS
J1 J2 J3 J4
192
CARRYOUT
216
258
260
224
228
220
222
218
230
226
44
232
234

SEQUENCE GENERATOR FOR AN ELECTRONIC MUSICAL INSTRUMENT

BACKGROUND OF THE INVENTION

The present invention is directed to a sequence generator system for generating a sequence of data corresponding to notes to be sounded by an electronic musical instrument, and particularly to such a sequence generator for use in an electronic musical instrument wherein a serial data stream is generated corresponding to notes actuated on the instrument, the sequence generator inserting a predetermined sequence of data into the serial data stream.

Electronic musical instruments of the type wherein a serial data stream is generated corresponding to notes actuated are generally known. Generally speaking, such instruments utilize multiplexers or similar scanning means to generate such a sequence of serial data. In a keyboard-type of instrument, one such scanning or multiplexing means is generally provided for each manual or keyboard of the instrument so as to generate separate serial data streams corresponding to the notes actuated on each manual or keyboard. Such known electronic musical instruments further include tone generating circuits responsive to the serial data stream for generating tones corresponding to the actuated notes.

Various arrangements have heretofore been provided for generating an additional data sequence corresponding, for example, to an arpeggio effect. Such systems include means for inserting this further data sequence into the serial data stream fed to the tone generating circuits, to cause the generation of a sequence of notes corresponding for example to an arpeggio effect. Heretofore, however, such arpeggio or other like accompaniment effect generating systems have depended upon relatively large memory components such as ROMs, to provide pre-programmed data sequences for insertion into the serial data stream in order to provide the desired effect. Accordingly, such systems have generally been limited in the number and type of effects available by constraints of the capacity of available memory circuits such as ROMs and also by the limited alternatives available for programming such memory components. Moreover, relatively large ROM-type memory components are relatively expensive, the programming thereof adding further expense to the production of the electronic musical instrument. Hence, only electronic musical instruments in a relatively highprice range have heretofore utilized such accompaniment generating systems.

OBJECTS AND SUMMARY OF THE INVENTION

Accordingly, it is a general object of the invention to provide a novel and improved sequence generator system for an electronic musical instrument.

A more specific object of the invention is to provide such a novel and improved sequence generator which is capable of producing a plurality of variations or sequences, so as to provide a plurality of musical effects, without requiring the provision of relatively expensive ROM-type components.

A related object of the invention is to provide a novel and improved sequence generator system of the foregoing type which is relatively simple and inexpensive in its construction, so that it may be provided in conjunction with moderately priced electronic musical instruments.

Briefly, and in accordance with the foregoing objects, a sequence generator according to the present invention comprises data steering means for receiving a serial data stream corresponding to the notes actuated on the instrument and for normally steering said serial data stream to a serial data output, sequence generating means responsive to said serial data stream for generating a further data sequence corresponding to a predetermined musical effect, and selectively actuatable means in said data steering means for inserting the data sequence generated thereby into the serial data stream delivered to said serial data output.

BRIEF DESCRIPTION OF THE DRAWINGS

The foregoing, as well as other objects, features and advantages of the present invention will be more readily appreciated upon reading the following detailed description of the illustrated embodiment together with reference to the accompanying drawings, wherein:

FIG. 4 illustrates the fashion in which FIGS. 3A, 3B and 3C are to be interfitted to form the circuit schematic diagram illustrated therein.

DETAILED DESCRIPTION OF THE ILLUSTRATED EMBODIMENT

Figure 1:
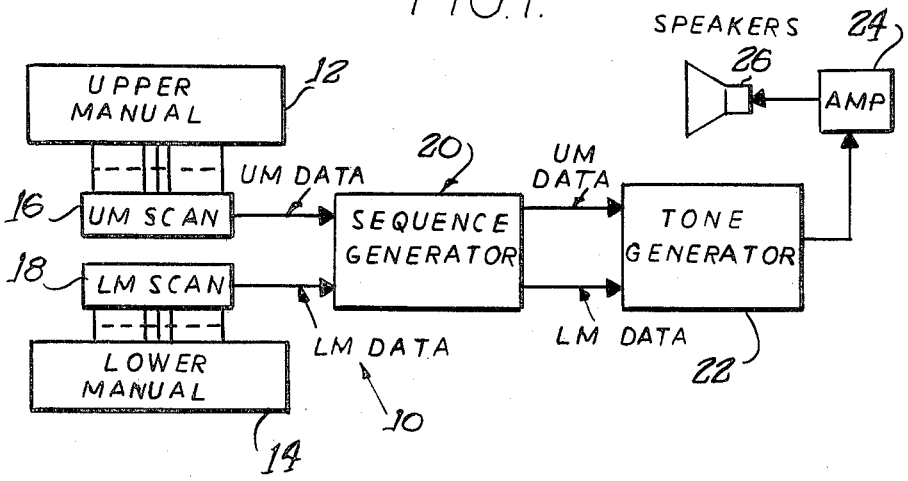
FIG. 1 is a block diagram of an exemplary electronic musical instrument incorporating a sequence generator system in accordance with the present invention.

Referring now to the drawings and initially to FIG. 1, an electronic musical instrument of the keyboard type is designated generally by the reference numeral 10. Generally speaking, this electronic musical instrument is of the type wherein an upper manual 12 and a lower manual 14 are scanned by suitable scanning or multiplexing circuits 16, 18, respectively. These upper manual and lower manual scanning or multiplexing circuits 16, 18, produce respective serial data trains corresponding to the conditions of the keys of the upper manual 12 and lower manual 14, respectively. That is to say, a serial data train is produced at the output of the upper manual scanning or multiplexing circuitry 16 which corresponds to the condition of each and every key of the upper manual, a data time slot or portion corresponding to an unactuated key assuming a first value or state and a data time slot or portion corresponding to an actuated key assuming a second value or state. Generally speaking, these first and second values or states of the data are encoded in binary fashion, whereby a logic "0" in the serial data stream corresponds to an unactuated key or note, while a logic "1" in the serial data stream corresponds to an actuated key or note.

A sequence generator system, designated generally by the reference numeral 20, is interposed in the serial data stream. When this sequence generator system 20 is not actuated, the serial data streams are passed through unaltered, with respect to both the upper manual and lower manual, to tone generator circuits 22. These tone generator circuits 22 are responsive to the respective serial data streams for generating tones or notes corresponding to the actuated keys or notes in accordance with the information contained in the respective serial data streams. One exemplary system utilizing keyboard scanning and tone generators of this type is shown for example in the co-pending application of Schwartz et al, Ser. No. 917,310, filed June 20, 1978. Moreover, the details of the structure and operation of tone generators such as the tone generators 22 which respond to such a serial data stream are illustrated for example in the co-pending applications of Schwartz et al, Ser. Nos. 917,313 and 917,314, both filed June 20, 1978. Accordingly, such keyboard scanning or multiplexing and tone generation components need not be described in additional detail herein.

Further in accordance with conventional practice, the tone signals generated by the tone generator circuits 22 are fed to conventional amplifier circuits 24 which drive speakers 26 for producing the desired tones or notes.

Figure 2:
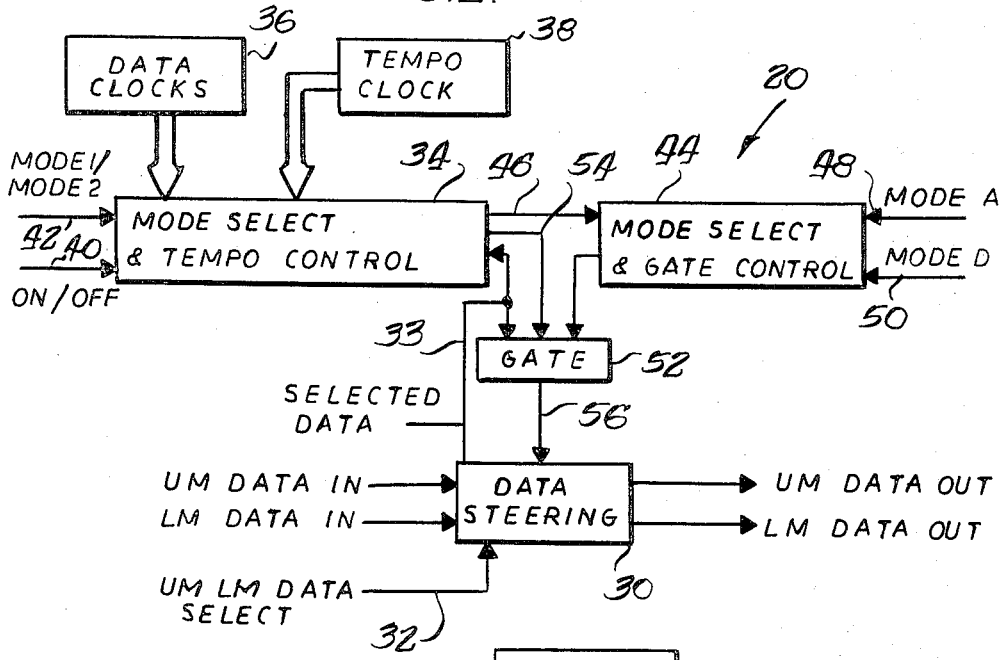
FIG. 2 is a block diagram of a sequence generator system in accordance with the present invention.
Figure 4:
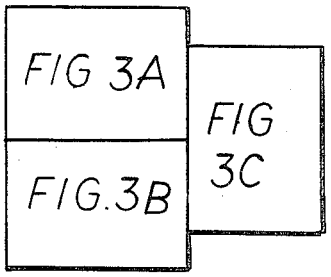

Referring now to FIG. 2, the sequence generator system 20 is illustrated in block form and comprises a number of functionally distinct components. Initially, the upper manual and lower manual data streams from the upper manual and lower manual scanning or multiplexing circuits 16, 18 are fed to a data steering circuit 30. Normally, this data steering circuit delivers the upper manual and lower manual data streams to respective upper manual and lower manual data outputs which directly feed the tone generator 22 of FIG. 1. However, an upper manual/lower manual data select control line 32 is provided, in response to which the data steering circuitry 30 feeds the selected data (either that of the upper manual or that of the lower manual) on a selected data line to a mode select and tempo control functional block 34. It will be understood that the data stream selected in this fashion is thereby diverted from its normal flow to the corresponding data output of the data steering circuit 30, to be modified in accordance with the novel principles of the invention.

This mode select and tempo control block 34 receives further control inputs from a plurality of data clocks 36 which generally provide master timing control signals for synchronization of the overall operation of the instrument 10 of FIG. 1. For example, such data clocks 36 provide a set of timing control signals suitable for controlling and synchronizing the operation of the upper manual and lower manual scanning or multiplexing components 16, 18 with the tone generators 22 of FIG. 1. This structure and its operation are more fully shown and described, for example, in the above-referenced co-pending applications and need not be further described herein. Additionally, a tempo clock 38 feeds a string of tempo pulses to the mode select and tempo control block 34. Briefly, these tempo pulses set the tempo of an accompaniment or rhythm produced by the electronic musical instrument 10. Such tempo pulse generators are well known and accordingly need not be further described herein.

The mode select and tempo control block 34 further receives control signals from a master on/off control 40 and from a first mode select control 42 which causes the selection of one of two possible modes or sequences to be generated by the sequence generator 20. These alternatively selectable sequences or modes are designated here as Mode 1 and Mode 2.

A further mode select and gate control functional block 44 receives a data stream on a line 46 from the mode select and tempo control block 34 for further manipulation thereof to form the desired data sequence. This mode select and gate control block 44 also receives further mode selection control signals from second mode control means 48 and 50, which are designated as MODE A and MODE D, respectively. The mode select and gate control circuit 44 feeds a serial data output to a gate circuit 52, which serial data controls the operation of the gate circuit 52.

Moreover, the gate circuit 52 also receives the selected data from the data steering block 30 and a tempo control output 54 from the mode select and tempo control block 34. The gate circuit 52 functions to gate through the selected data in accordance with the control signals received from the mode select and tempo control circuit 34 and from the mode select and gate control circuit 44. Accordingly, an output 56 of the gate circuit 52 feeds a serial data stream to the data steering circuit 30 which corresponds to a sequence of notes or tones comprising a predetermined musical effect, such as an arpeggio effect. The data steering block 30 then feeds the data stream from the line 56 to the selected one of the upper manual data output or lower manual output in accordance with the position or state of the data select control input 32.

Consequently, a serial data stream or sequence corresponding to a predetermined musical effect such as an arpeggio is substituted at the selected one of the upper manual and lower manual data output to the tone generators 22 of FIG. 1. This causes the tone generators 22 to produce the corresponding sequence of notes or tones, for example so as to generate notes or tones corresponding to an arpeggio effect.

Reference is next invited to FIG. 3, wherein a schematic circuit diagram further illustrates the structure and function of the sequence generator system 20 shown in block form in FIG. 2.

Figure 3A:
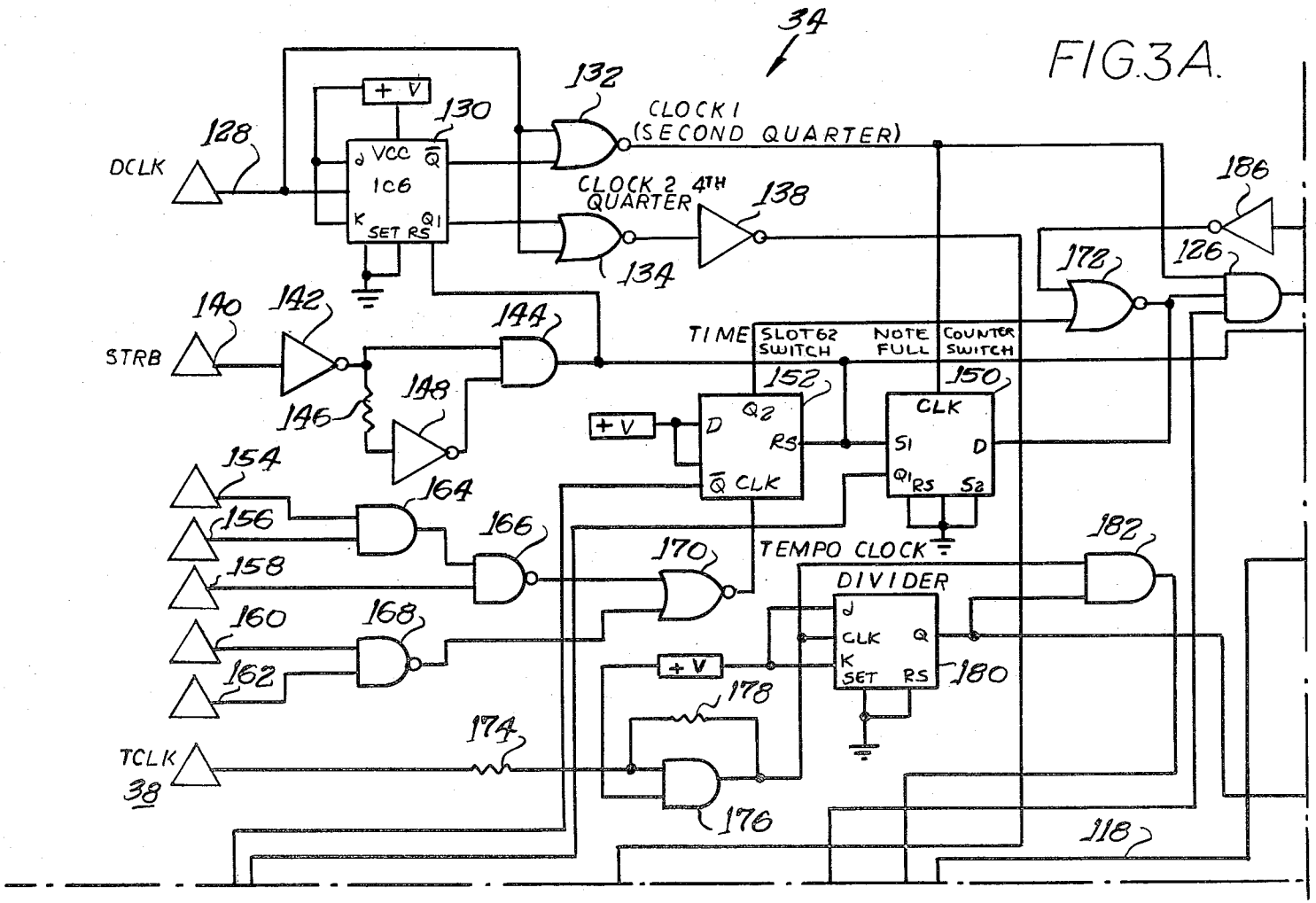
FIGS. 3A, 3B and 3C, taken together, form a circuit schematic diagram of an exemplary embodiment of a sequence generator system in accordance with the present invention.
Figure 3B:
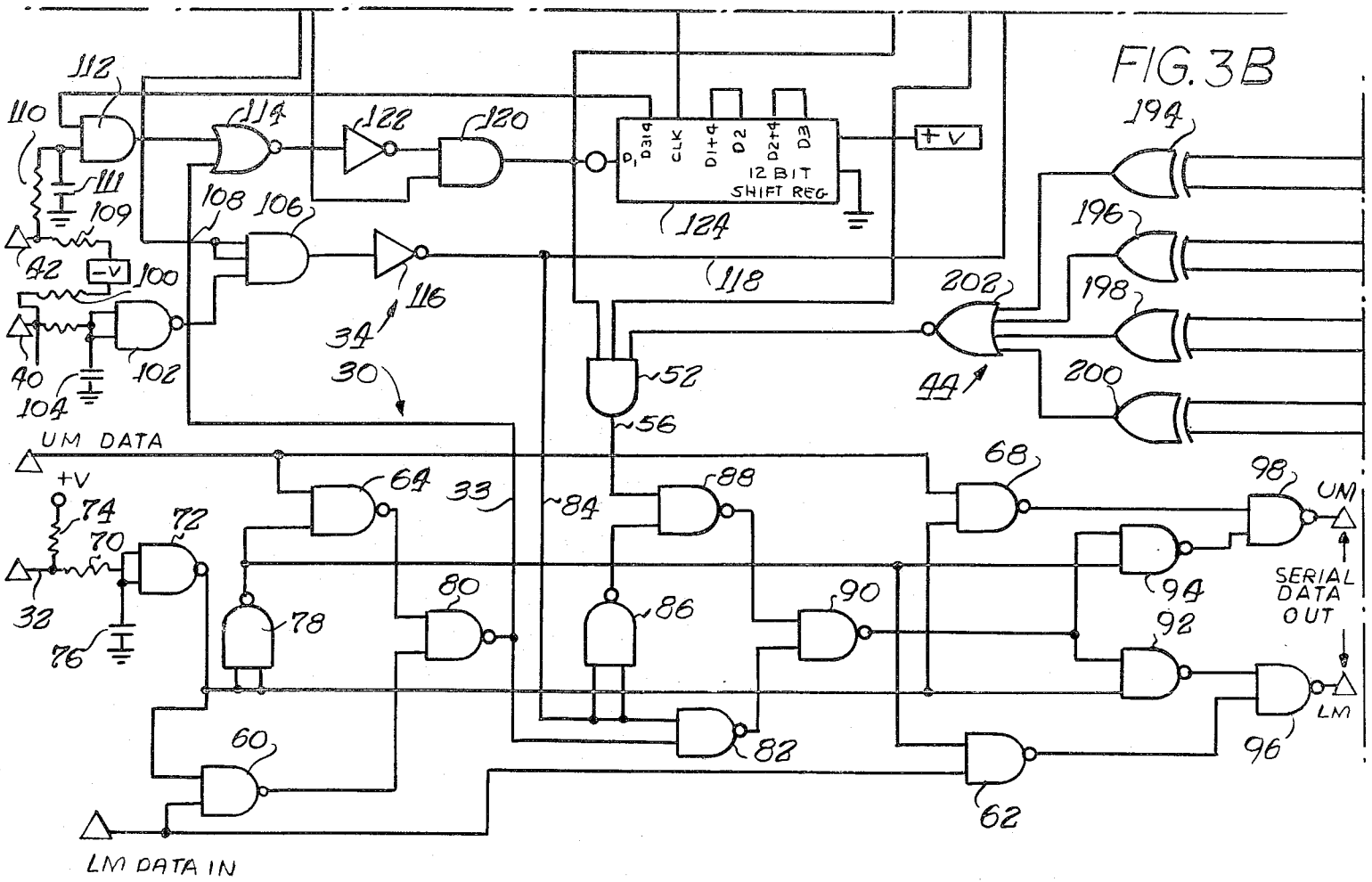

Referring initially to FIG. 3B, the upper manual serial data and lower manual serial data are fed to one input each of similar pairs of two-input NAND gates 60, 62 and 64, 68. The upper/lower data select control 32 is fed by way of a resistor 70 to both inputs of a two-input NAND gate 72, which functions as an inverter. A suitable pull up resistor 74 is provided at the control line 32 and a suitable capacitor 76 to ground is provided at the inputs of the NAND gate 72.

The output of the NAND gate 72 feeds both inputs of a further two-input NAND gate 78 which also functions as an inverter and whose output feeds the remaining input of each of the NAND gates 64 and 62. Similarly, the output of the NAND gate 72 also feeds the remaining input of each of the NAND gates 60 and 68. Accordingly, it will be seen that the state of the upper manual/lower manual select signal results in inversely related logic signals being fed to the respective upper manual and lower manual serial datareceiving gates 60, 62 and 64, 68. The outputs of the NAND gates 60 and 64 feed respective inputs of a further two-input NAND gate 80 whose output comprises the selected data and feeds the selected data line 33. This same output of the NAND gate 80 also feeds the selected data to one input of a further two-input NAND gate 82, whose other input receives a master on/off control signal on a control line 84 from the mode select and tempo control circuit 34 to be described hereinbelow.

This control line 84 also feeds both inputs of a two-input NAND gate 86 which functions as an inverter and whose output thereby feeds an opposite sense control signal to one input of a further two-input NAND gate 88. The outputs of the NAND gates 82 and 88 feed the respective inputs of a two-input NAND gate 90 whose output feeds one input of each of a further pair of two-input NAND gates 92 and 94. The remaining input of the NAND gate 92 receives the output from the NAND gate 72 while the remaining input of the NAND gate 94 receives the inverted sense of this output by way of the NAND gate 78. The output of the NAND gate 92 feeds one input of a further two-input NAND gate 96 while the output of the NAND gate 94 feeds one input of a similar two-input NAND gate 98. The remaining input of the NAND gate 96 receives the output of the NAND gate 62 while the remaining input of the NAND gate 98 receives the output of the NAND gate 68. The output of the NAND gate 96 forms the lower manual serial data output while the output of the NAND gate 98 forms the upper manual serial data output.

The remaining input of the NAND gate 88 receives a serial data output from the output of the gate circuit 52 of FIG. 2 which comprises a three-input AND gate.

In operation, it will be seen that the foregoing circuit may simply feed both upper and lower manual serial data streams through to their respective upper manual and lower manual serial data outputs. Alternatively, in response to the actuation of the upper manual/lower manual data select control 32 and the on/off control signal at the line 84, one of the upper manual or lower manual serial data may be diverted from the data steering circuit 30 to the selected data line 33. Similarly, the serial data output from the gate 52 may be selectively fed into the data steering circuit 30 by way of the gate 88, from which it may be fed to either the upper manual or lower manual data outputs by way of the remaining gates 90, 92, 94, 96 and 98, in accordance with the state of the data select control 32. That is, if the upper manual data is diverted by operation of the data select control to the line 33, then the upper manual data is in effect replaced by the serial data from the gate 52 at the upper manual data output at the NAND gate 98. Conversely, if the lower manual data is chosen by the data select control 32 to be fed out on the line 33, then the serial data from the gate 52 is ultimately passed to the lower manual data output at the output of the NAND gate 96.

Referring now also to FIG. 3A, the mode select and tempo control portion 34 of the sequence generator 20 is shown in additional detail. The master on/off control signal on the line 40 is provided with a suitable pull-up resistor 100 and feeds both inputs of a two-input NAND gate 102, which functions as an inverter. These inputs are also provided with a suitable capacitor 104 to ground. The output of the NAND gate 102 feeds one input of a three-input AND gate 106 whose remaining two inputs are fed in common from a control line 108 to be discussed later.

The Mode 1/Mode 2 selection control signal at the input 42 is provided with a pull-up resistor 109 and with a series resistor 110 to one input of a two-input AND gate 112, whose output feeds one input of a two-input NOR gate 114. The remaining input of this NOR gate 114 is fed by the selected data line 33 from the data steering circuit 30 as discussed above. The output of the AND gate 106 feeds an inverter buffer 116 whose output feeds the on/off control line 84 of the data steering circuit 30 discussed above and also feeds a further control line 118 to the mode select and gate control circuit 44, to be discussed hereinbelow.

The output of the NOR gate 114 feeds one input of a two-input AND gate 120 by way of an inverter buffer 122. The output of the AND gate 120 feeds a data input of a twelve-bit shift register 124. Advantageously the shift register 124 is wired for use as a recirculating shift register, the data therefrom recirculating from the highest order bit to the remaining input of the AND gate 112 and thence by way of the gates 114, 122 and 120 back to the data input. In the illustrated embodiment, the shift register 124 comprises a pair of dual four-bit shift registers of the CMOS type generally designated as 4015, wired as a twelve-bit shift register. This same output of AND gate 120 also feeds one of the three inputs of the gate circuit 52.

In accordance with the foregoing, it will be appreciated that the twelve-bit shift register 124 recirculates data with a twelve-bit delay, thereby effectively inserting into the serial data stream fed to the gate circuit 52. data corresponding not only to the actuated notes in the selected data stream but also to notes octavely related thereto. This data stream comprising the selected data stream and octavely related note data is also fed to one input of a three-input AND gate 126, whose remaining inputs are fed from the remaining control circuitry of FIG. 3A.

Briefly, this control circuitry is responsive to the data clocks 36 and tempo clock 38 of FIG. 2 for generating suitable timing or clock control signals for operation of the system of the invention. This timing control is similar to the timing or clock control of the operation of the electronic musical instrument 10 of FIG. 1, and in particular of the operation of the upper manual and lower manual scanning or multiplexing circuits 16, 18 and of the tone generators 22 to effect synchronization of the joint operation thereof.

In this regard, a master data clock input 128 feeds one input of a JK-type flip-flop 130 whose Q output and $\overline{Q}$ output respectively feed one input of each of a pair of two-input NOR gates 132, 134. In the illustrated embodiment, the flip-flop 130 comprises one-half of a dual JK flip-flop, of the type generally designated 4027. The remaining inputs of these NOR gates 132, 134 are fed directly from the data clock input 128. The output of the NOR gate 132 feeds a second input of the three-input AND gate 126 with a data pulse comprising the second quarter of each pulse period from the clock input 128. The NOR gate 134 feeds a data pulse comprising the fourth quarter of each pulse period from the clock input 128 to the clock or shift input of the twelve-bit shift register 124, by way of an inverter 138. A system strobe clock input 140 feeds an inverter 142 whose output feeds one input of a two-input AND gate 144, the remaining input of which is fed from the same inverter 142 by way of a series-connected resistor 146 and further inverter 148. The output of this AND gate 144 feeds the reset input of the flip-flop 130 and also feeds the set input of a D-type flip-flop 150 and the reset input of another D-type flip-flop 152. The flip-flops 150 and 152 form a switching or control circuit for effectively disabling the operation of the sequence generator system so as to limit the operation thereof to the time period corresponding to the time period for scanning or multiplexing of the upper and lower manuals. In the illustrated embodiment the flip-flops 150 and 152 comprise a dual-D flip-flop of the type generally designated 4013.

Further, in this regard, a plurality of multiplex control clock signals which form the master timing control of the electronic musical instrument are fed in on inputs 154, 156, 158, 160 and 162. These multiplex control signals form a portion of a seven-bit master timing control signal which defines 128 separate time slots in which various aspects of control of the electronic musical instrument 10 of FIG. 2 are carried out. Briefly, the first 61 of these time slots are reserved for the scanning or multiplexing of the upper and lower manuals 12, 16 by their respective scanners or multiplexer circuits 16, 18. Accordingly, the illustrated system is capable of accommodating an electronic musical instrument of the keyboard variety having as many as 61 notes or keys in each manual thereof. The remaining time slots of the 128 division or seven-bit control cycle are reserved for other control systems of the instrument which are unrelated to these upper manual and lower manual serial data streams and hence are not relevant to understanding the present invention.

The multiplex control clock signals at inputs 154 and 156 feed respective inputs of a two-input AND gate 164 whose output feeds one input of a two-input NAND gate 166. The multiplex control clock signal at the input 158 feeds the remaining input of the NAND gate 166. Similarly, the multiplex control clock signals at the inputs 160 and 162 feed respective inputs of a two-input NAND gate 168 whose output feeds one input of a two-input NOR gate 170. The remaining input of this NOR gate 170 is fed from the output of the NAND gate 166. The output of the NOR gate 170 feeds the clock input of the flip-flop 152. The Q output of the flip-flop 152 feeds one input of a two-input NOR gate 172 whose output feeds both the D input of the flip-flop 150 and the third input of the three-input AND gate 126.

In operation, the foregoing arrangement of the multiplex control clock inputs 154–162, inclusive, the flip-flops 150, 152 and the intervening logic is such as to produce suitable output control signals to effectively cease the operation of the sequence generator of the invention after the 61st time slot of the 128 division multiplexing cycle described above. That is to say, the operation of the sequence generator is stopped when the scanning of the upper and lower manuals have been completed. Additionally, the $\overline{Q}$ output of the flip-flop 152 feeds the control line 108 at the inputs of the AND gate 106 while the Q output of the flip-flop 150 feeds the remaining input of the AND gate 120, thus also effectively disabling the operation of the twelve-bit shift register 124 and of the data steering circuit 30 when the keyboard scanning is complete.

The tempo clock 38 feeds the tempo signal by way of a resistor 174 to one input of a two-input AND gate 176 which input is provided with a feedback resistor 178 from the output thereof. This output of the AND gate 176 also feeds the clock input of a JK-type flip-flop 180, whose J and K inputs, together with the remaining input of the AND gate 176 are fed from a suitable positive voltage supply. The Q output of the flip-flop 180 is fed to one input of a two-input AND gate 182 whose remaining input receives the output of the AND gate 176 directly. In the illustrated embodiment, the flip-flop 180 comprises the other one-half of the dual JK flip-flop type 4027, of which the flip-flop 130 comprises the first one-half.

The output of the AND gate 182 drives a second input of the gating circuit 52 so as to permit the gating through of the serial data on the first input thereof in accordance with the tempo selected. In accordance with one practical and preferred embodiment, the frequency of the tempo signal pulse train produced by the tempo clock 38 is from on the order of 5 Hz to on the order of 50 Hz, in accordance with the tempo selected by the player of the instrument.

As a specific example to which no limitation is intended, in the illustrated embodiment the frequencies of the data clock control signals are substantially as follows: the clock signal at the input 128 has a frequency of substantially 106 KHz and the clock signal at the input 154 has a frequency of substantially 13 KHz, the remaining clock signals at the inputs 156, 158, 160 and 162 are each divided-by-two from the last preceding clock frequency starting with the 13 KHz at input 154. The strobe STRB on the line 140 occurs at the end of each 128 time slots of the multiplexing or scanning cycle described above. The third and final remaining input of the gating circuit 52 is fed from the output of the mode select and gate control circuit 44, which will now be described with reference to FIG. 3C.

The output of the AND gate 126 feeds the clock input of a note counter 184 which in the illustrated embodiment is a four-bit binary counter integrated circuit component of the CMOS type generally designated 4029. The carryout input of the counter 184 feeds an inverter buffer 186 which in turn feeds the second input of the two-input NOR gate 172 of FIG. 3A. The reset input of the note counter 184 is fed from the strobe pulse output of FIG. 3A by way of the inverter 142 and the AND gate 144. Accordingly, the note counter effectively advances one count for each data pulse produced at the input of the twelve-bit shift register 124, as fed thereto by way of the AND gate 126. This counting is also under the control of the data clock derived pulses from the NOR gate 132 and the cutoffs provided by the flip-flops 150 and 152. In this regard, the flip-flop 152 is actuated when the counter 184 is "full", in response to the carryout output thereof, via inverter 186 and gate 172.

The four-bit binary output of the note counter 184 is fed to the four inputs of a four-bit latch integrated circuit component 188 whose latching or clock input is fed from the control line 118 from the control circuits of FIGS. 3A and 3B. In the illustrated embodiment the latch 188 is a four-bit latch of the CMOS type, generally designated 40174. In effect, the latch 188 latches the count from the note counter 184 at the end of the keyboard scan cycle, which comprises the first 61 time slots of the multiplex control cycle as mentioned above.

A tempo counter integrated circuit 190 also comprises a four-bit binary counter of the CMOS type, generally designated 4029, and receives its clock input from the Q output of the flip-flop 180 of FIG. 3A. This Q output also feeds one input of a two-input AND gate 192 whose output feeds the reset input of the tempo counter 190. The four-bit binary output of the tempo counter 190 is fed to one input of each of four exclusive-OR gates 194, 196, 198 and 200 which receive their second inputs from the corresponding binary-coded bit output of the note counter 184. These exclusive-OR gates 194, 196, 198 and 200 feed the respective inputs of a four-input NOR gate 202, and hence these components comprise a four-bit comparator for comparing the four-bit outputs of the note counter 184 and tempo counter 190.

The NOR gate 202 feeds the third input of the gate circuit 52 and accordingly when the number of notes played on the instrument as counted by the note counter 184 is the same as a given count in the tempo pulses reached by the tempo counter 190, the gate 52 will be effectively enabled from the four-bit comparator comprising the exclusive-OR gates 194–200, inclusive and the NOR gate 202. Hence, upon receipt of a synchronizing tempo pulse at the second control input of the gate circuit 52, the serial data present at the third input thereof from the input of the twelve-bit shift register 124 will be fed back through to the data steering circuit for reproduction thereby at the selected serial data output.

While the invention is not so limited, the provision of the four-bit note counter 184 limits the illustrated embodiment to a 15-note performance range. For example, if three notes are actuated or played on the instrument and the twelve-bit shift register is enabled for recirculating by a suitable actuation of the mode control 42, the three notes played will be counted in addition to the three octavely related notes in each succeeding higher octave, up to the maximum capacity of 15 notes. Moreover, it will be recognized that the rate of the tempo counter 190 is substantially orders of magnitude lower than the rate of the note counter 184, whereby the serial data pulse corresponding to the first actuated note will be gated through repeatedly, in each successive scan cycle, to the data steering circuit, as long as the first tempo pulse is still present at the tempo counter 190, that is, until the next tempo pulse from divider 180 is received. Accordingly, the tone generation circuits 22 of FIG. 1 will continue to produce the first keyed or played note for the period of the tempo pulse thereafter supplying a suitable decay thereto, in the fashion described in the above-referenced co-pending applications.

Upon production of the next tempo pulse from divider 180, the second note counted by the note counter will enable the serial data corresponding to the second note keyed or actuated to be passed through into the serial data stream for production thereof by the tone generators 22 of FIG. 1 in the same fashon. This process continues for each successive note actuated or keyed, and then for the octaves thereof as produced by the action of the recirculation of the twelve-bit shift register 124. Accordingly, it will be recognized that the sequence of data passed through to the serial data stream corresponds substantially to a sequence of notes forming an arpeggio effect over one or more octaves.

Figure 3C:
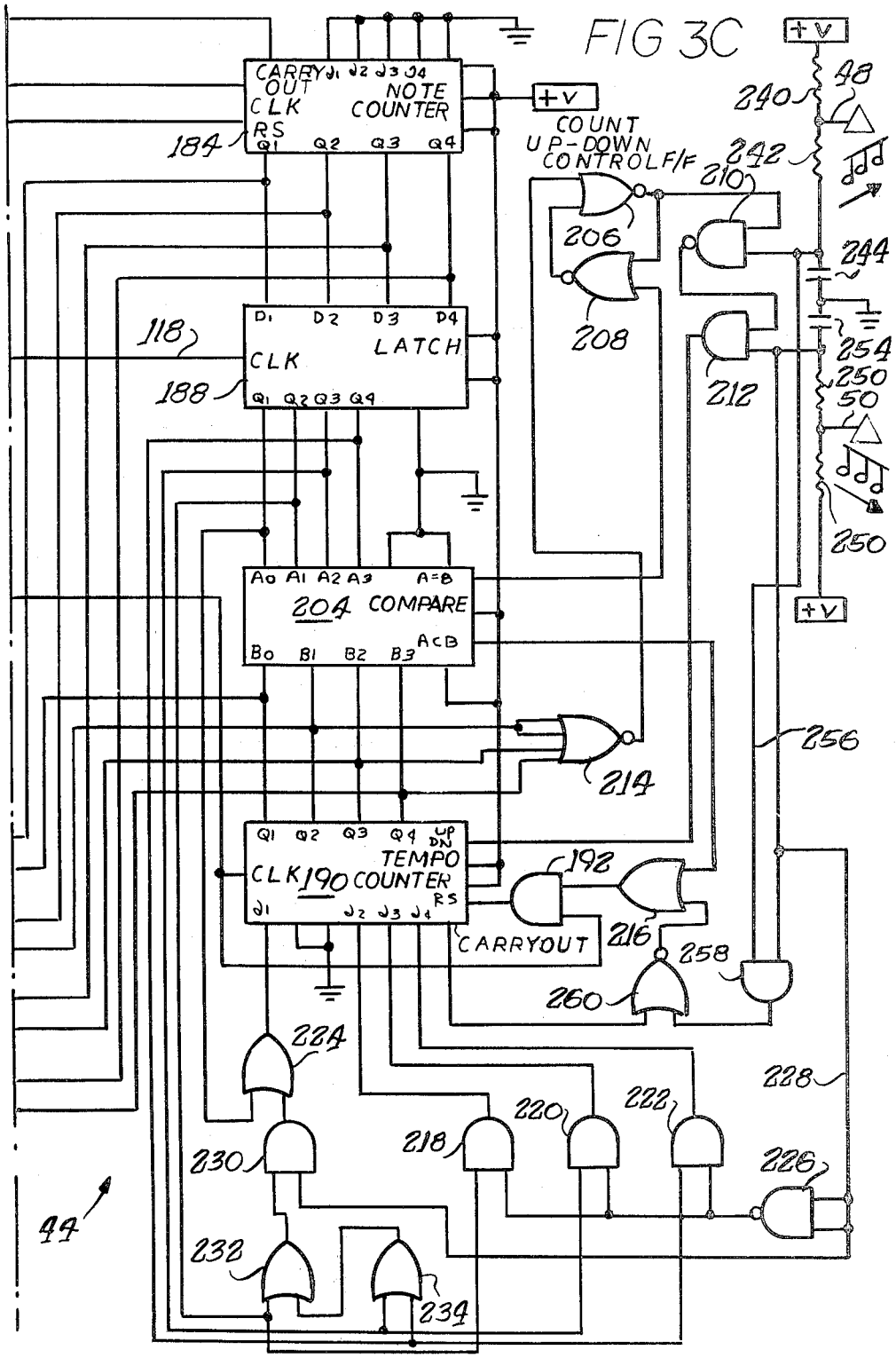

Referring still to FIG. 3C, additional modes of operation are provided by the circuits of the present invention. In this regard, a second comparator is provided in the form of a four-bit comparator integrated circuit component 204 which in the illustrated embodiment comprises a four-bit binary comparator of the CMOS type, generally designated 4063. This comparator 204 receives one four-bit input (A) from the output of the latch 188 and the other four-bit input (B) from the output of the tempo counter 190. Further in this regard, the tempo counter 190 is an up/down counter having an up/down control input fed from circuits associated with the remaining mode control inputs 48, 50. Briefly, in the absence of actuation of either of the mode control inputs 48, 50, the tempo counter 190 will be switched from the up counting mode to the down counting mode in response to the A = output of the comparator 204, by way of an up/down control flip-flop comprising a pair of NOR gates 206, 208. The output of the NOR gate 206 feeds one input of a two-input NAND gate 210 whose output in turn feeds one input of a two-input AND gate 212. The output of this latter AND gate 212 feeds the up/down control pin of the tempo counter 190.

From the foregoing it will be appreciated that the latch 188 holds the maximum count reached by the note counter 184 at the end of the keyboard scan cycle. Accordingly, when the count of the tempo counter 190 has reached this maximum number, the serial data corresponding to all of the actuated notes (and octaves thereof when the twelve-bit shift register 124 has been enabled for circulation) have been enabled at the gate circuit 52. Accordingly, a descending mode is entered wherein the tempo counter counts back downwardly, again enabling the serial data corresponding to notes played and octaves thereof in reverse order. In this fashion, the serial data produced at the selected output of the data steering circuit 30 will correspond to an ascending and descending arpeggio effect comprising the notes actuated and a plurality of octavely related notes, up to the 15-note capacity of the note counter 184. Accordingly, this system will continue to sound an ascending and descending arpeggio effect comprising the notes actuated by the player and octaves thereof until the player actuates a different note or notes, at which time the arpeggio effect will be produced comprising the newly actuated note or notes and their octaves. Moreover, in view of the relatively fast rate of the note counters as compared to the tempo counter, the player is not required to actuate the notes forming the desired sequence or arpeggio effect precisely simultaneously, as the system corrects very rapidly for new note data received in subsequent scans.

Briefly, it will also be appreciated the flip-flop control and succeeding gates 210, 212 will change state upon the tempo counter reaching the "one" count while in the down counting direction, due to the action of a four-input NOR gate to 214 wired to respond to this "one" count. This NOR gate 214 triggers the flip-flop comprising NOR gates 206, 208 to feed the opposite sense logic to the up/down control input of the tempo counter 190, to repeat the up count and thereby again produce the ascending portion of an arpeggio effect or similar sequence.

Additonally, the A<B output of the comparator 204 feeds one input of a two-input OR gate 216 whose output feeds the remaining control input of the AND gate 192 to effect resetting of the tempo counter 190. Generally, this condition A<B may occur if a lesser number of notes are activated as detected in a succeeding scan. Accordingly, upon advancement of the tempo counter to a count above the count corresponding to the number of notes counted and held in the latch 188, a reset input of the tempo counter 190 is activated. This "reset" activation effectively resets the tempo counter 190 to count 1 if it is in the up counting mode, or to the count stored in the latch 188 if the tempo counter 190 is in the down counting mode. This stored latch count is received at a four-bit input of the tempo counter 190 by way of three AND gates 218, 220, and 222 and an OR gate 224.

The inputs of these three AND gates 218, 220, and 222 are respectively fed from the three highest bit outputs of the latch 188, while one input of the OR gate 224 is fed from the lowest bit output of the latch 188. The remaining or control input of each of the three AND gates 218, 220, and 222 is fed from the output of a two-input NAND gate 226 which receives both of its inputs from a control line 228. The remaining or control input of the OR gate 224 is fed from the output of a two-input AND gate 230 which receives one input from the same control line 228 and a remaining input from a two-input OR gate 232. The OR gate 232 receives one input from the second lowest bit output of the latch 188 and a remaining input from the output of a further two-input OR gate 234. This OR gate 234 receives its inputs respectively from the two highest bit outputs of the latch 188.

The mode control input 48 (MODE A) comprises an ascending mode only control which when actuated limits the tempo counter to repetition of its up counting mode, thereby repetitively producing only the ascending portion of the sequence or arpeggio effect. Similarly, actuation of the mode control input 50 (MODE D) limits the tempo counter to repetition of the down counting mode, thereby repetitively producing only the descending portion of the sequence or arpeggio effect. Briefly, the ascending control input 48 when actuated effectively grounds a positive potential otherwise provided through a resistor 240, thus providing a ground level or "0" logic signal through a resistor 242 to the remaining input of the NAND gate 210, which input is also provided with a suitable capacitor 244 to ground. Similarly, the MODE D control input 50 when actuated effectively grounds a positive potential otherwise provided through a similar resistor 250, to provide a ground potential or "0" logic signal through a second resistor 252 to the remaining control input of the two-input AND gate 212, which input is also provided with a suitable capacitor 254 to ground. This control logic signal at the second or control input of the AND gate 212 also forms the control signal on the control line 228 mentioned above. Similarly, the ascending mode control signal at the second or control input of the AND gate 210 feeds a second control line 256. These control lines 228 and 256 also feed the respective inputs of a two-input AND gate 258 whose output feeds one input of a two-input NOR gate 260. The output of this NOR gate 260 feeds the remaining input of the OR gate 216 for control of the reset of the input of tempo counter 190. The remaining input of the NOR gate 260 is fed from the carryout output of the tempo counter 190.

Briefly, the foregoing logic arrangement cooperates with the above-described "resetting" arrangement so that the tempo counter may be controlled to repetitively count first in the up mode and then in the down mode between "one" and the number of notes to be actuated, as determined by the latch 188 and note counter 184. Alternatively, either the up mode or down mode may be effectively disabled and the other mode repetitively produced by operation of one of the controls 48, 50. The resulting effect on the serial data stream produced at the output of the gate 52 is to produce a repeating serial data stream or sequence corresponding to either an ascending arpeggio effect, a descending arpeggio effect or an alternatively ascending and descending arpeggio effect or sequence.

What has been described herein is a novel sequence generator for an electronic musical instrument. While a specific embodiment has been illustrated and described herein the invention is not limited thereto. On the contrary, various alternatives, changes and modifications may occur to those skilled in the art upon reading the foregoing descriptions. Accordingly, such alternatives, changes and modifications are to be considered as forming a part of the present invention insofar as they fall within the spirit and scope of the appended claims.

The invention is claimed as follows:

1. In an electronic musical instrument wherein scanning means scans the instrument and produces a serial data stream corresponding to notes played on the instrument in ascending order, a sequence generator system comprising: sequence generating means responsive to said serial data stream for repeatedly generating a sequence data stream corresponding, in sequentially ascending order, to the notes played and to all notes in higher octaves and octavely related to the notes played, said sequence generating means including recycling memory means receiving said serial data stream, and further including means for summing said serial data stream and the output of said recycling memory means to generate said sequence data stream, sequence control means for selecting data from said sequence data stream in either ascending order or descending order and data steering means for receiving said serial data stream and said data selected from said sequence data stream and for normally steering said serial data stream to a data output and selectively actuatable for substituting said data selected from said sequence data stream for said serial data stream at said data output.

2. In an electronic musical instrument according to claim 1 and further including mode selecting means, and wherein said sequence control means is responsive to said mode selecting means for repeatedly selecting data from said sequence data stream corresponding only to notes playable by said instrument and in said ascending order only, in said descending order only, or in said ascending order followed by said descending order.

3. In an electronic musical instrument according to claim 1 or claim 2 wherein said electronic musical instrument includes tempo generating means for generating a sequence of tempo pulses corresponding to a selectable tempo of an accompaniment to be sounded by said electronic musical instrument and wherein said sequence control means includes means responsive to said tempo pulses for selecting said data from said sequence data stream in accordance with the selected tempo.

4. In an electronic musical instrument according to claim 3 wherein said sequence control means includes gate means for gating said selected data in accordance with the selected tempo.

5. In an electronic musical instrument according to claim 2 wherein said mode selecting means includes means selectable for disabling the generating by said sequence generating means of said data corresponding to said notes octavely related to the notes played.

6. In an electronic musical instrument according to claim 1 wherein said instrument is of the keyboard variety including an upper manual and a lower manual and including means for producing an upper manual serial data stream corresponding to keys depressed on said upper manual and a lower manual serial data stream corresponding to keys depressed on said lower manual and wherein said data steering means separately receives said upper manual serial data stream and said lower manual serial data stream and includes an upper manual data output and a lower manual data output to which said upper manual and lower manual serial data streams are normally respectively fed, and wherein said data steering means includes means for selectively substituting said selected data in place of either of said upper manual serial data stream or said lower manual serial data stream at the respective upper manual data output or lower manual data output.

7. In an electronic musical instrument including scanning means for repeatedly scanning the instrument at a predetermined rate and for generating serial data corresponding to actuated notes in ascending order and further including tempo generating means for generating a series of tempo pulses at a preselected tempo rate, a sequence generator comprising: a serial data output, recirculating shift register means for receiving said serial data and for repeatedly recirculating the data therein at a rate corresponding to the predetermined scanning rate, means for summing said serial data and the recirculated data to generate a sequence data stream corresponding to the notes played and to all notes in higher octaves which are octavely related to the notes played in ascending order, note counting means for receiving said sequence data stream and for counting the number of notes therein, tempo counting means for receiving and counting said tempo pulses, comparator means for comparing the counts of said note counting means and said tempo counting means and producing a control output signal when the counts are equal and gate means for receiving said sequence data stream and said tempo pulses and said control output signal for gating through said sequence data stream in a predetermined fashion to said serial data output so as to repeatedly produce a sequence of serial data corresponding to the sequence of the actuated notes and the octaves thereof playable by the instrument in ascending order and at a preselected tempo corresponding to the rate of the tempo pulses, thereby repeatedly generating serial data corresponding substantially to an arpeggio effect at a selected tempo.

8. In an electronic musical instrument according to claim 7 said sequence generator further including latch means for latching the count of said note counting means at the end of one complete scan of the instrument, second comparator means for comparing the counts of said latch means and said tempo counting means and producing a second control output signal when the counts are equal, and wherein said tempo counting means comprises an up/down counter, said second control signal controlling the direction of said up/down counter so as to generate said sequence of serial data at said serial data output in both ascending and descending order, thereby repeatedly generating serial data corresponding substantially to an ascending and descending arpeggio effect.

9. In an electronic musical instrument according to claim 7 or claim 8 and further including mode control means selectively actuatable for disabling said recirculating shift register means so as to cease generating sequence data corresponding to notes octavely related to the notes actuated.

10. In an electronic musical instrument according to claim 8 wherein said recirculating shift register means comprises a 12-bit recirculating shift register.

11. In an electronic musical instrument according to claim 8, said sequence generator further including mode selecting means selectively actuatable for disabling one of the directions of said up/down counter and for causing said up/down counter to repeatedly count in one direction only so as to repeatedly generate said sequence of serial data corresponding only to the ascending portion or the descending portion of said arpeggio effect.

12. In an electronic musical instrument according to claim 11 wherein said mode control means further includes means selectively actuatable for disabling said recirculating shift register means so as to cease generating said sequence data corresponding to notes octavely related to the notes actuated.

13. In an electronic musical instrument according to claim 11 wherein said mode selecting means further includes means coupled intermediate said latch means and said tempo counting means for presetting said tempo counting means for repeatedly generating said sequence of serial data corresponding only to the descending portion of said arpeggio effect.

14. In an electronic musical instrument according to claim 11 or claim 13 wherein said mode selecting means further includes means for resetting said tempo counting means so as to generate said sequence of data corresponding only to the ascending portion of said arpeggio effect.

* * * * *

UNITED STATES PATENT AND TRADEMARK OFFICE

CERTIFICATE OF CORRECTION

PATENT NO. : 4,319,509

DATED : March 16, 1982

INVENTOR(S) : WILLIAM V. MACHANIAN

It is certified that error appears in the above-identified patent and that said Letters Patent are hereby corrected as shown below:

Column 9, line 62, change "A= " to -- A=B --.

Signed and Sealed this

*Eighth* Day of *June 1982*

[SEAL]

*Attest:*

GERALD J. MOSSINGHOFF

*Attesting Officer*

*Commissioner of Patents and Trademarks*